United States Patent [19]

Safrit et al.

[11] 4,421,258

[45] Dec. 20, 1983

[54] PANTY HOSE SIZING FORM

[75] Inventors: Sam C. Safrit, Pfafftown; William B. Cothran, Burlington, both of N.C.

[73] Assignee: Kayser-Roth Hosiery, Inc., Burlington, N.C.

[21] Appl. No.: 358,031

[22] Filed: Mar. 15, 1982

[51] Int. Cl.[3] ..... D06H 3/16

[52] U.S. Cl. ..... 223/75; D20/32

[58] Field of Search ..... 223/75, 76, 77; D20/32; D32/59

[56] References Cited

U.S. PATENT DOCUMENTS

| | | | |
|---|---|---|---|
| 794,106 | 7/1905 | Keene | 223/75 |
| 3,490,076 | 1/1970 | Matthews | 223/75 X |
| 3,519,175 | 7/1970 | Fregeolle | 223/75 |

*Primary Examiner*—Louis Rimrodt

*Attorney, Agent, or Firm*—Bell, Seltzer, Park & Gibson

[57] ABSTRACT

A pair of spaced-apart and identically shaped elongate boards is supported for vertical adjustment on a pedestal-type stand. The boards are interconnected and maintained in spaced-apart relationship at their lower ends and the upper or free toe end portions are spaced apart so that the panty hose can be easily drawn onto and off of the sizing form. Opposite side edges of the boards are contoured symmetrically with gradually curving configurations which progressively increase in width from the free toe ends downwardly to the panty portion so that the panty hose can be easily drawn onto and removed from the sizing form. The shape of the form permits the panty hose to be positioned on the sizing form with the fabric in uniformly stretched condition throughout all areas of the panty hose.

8 Claims, 7 Drawing Figures

PANTY HOSE SIZING FORM

FIELD OF THE INVENTION

This invention relates generally to a panty hose sizing form and more particularly to a sizing form including a pair of spaced-apart identically shaped and elongate boards which are symmetrically contoured along opposite sides so that the panty hose may be easily drawn onto and removed from the form. The form is shaped to indicate if the proper volumetric area is present in each portion of the panty hose.

BACKGROUND OF THE INVENTION

Ladies' sheer panty hose are usually knit of a stretchable yarn so that the panty hose have sufficient stretch characteristics to properly fit a limited range of body and leg sizes and panty hose are usually produced in three to five or more different sizes to cover substantially the full range of sizes of women in the population. During the manufacture of panty hose, it is common practice to inspect the panty hose for defects or imperfections, such as picks, runs and the like. While this is an important function to insure that the wearer does not receive a panty hose with these defects therein, the purchaser is concerned primarily with obtaining the proper size panty hose which provides a comfortable fit throughout the entire length of the panty hose, from the panty portion and throughout the length of the legs and feet. If the panty hose purchased are too small, the wearer will be unduly constricted in portions of the lower body and/or leg areas. Also, if the panty hose are too large for the wearer, the panty hose will have a tendency to work itself downwardly on the body and legs and cause unsightly wrinkles. Panty hose packaging currently provides a size indication, usually in the form of a chart correlated with weight and height, to indicate the range of various sizes of ladies which the particular panty hose will properly fit. When a lady purchases panty hose which are indicated as being proper for her particular weight and height and then finds that the panty hose are either too large or too small, she will be very unlikely to again purchase that particular brand of panty hose.

In an attempt to standardize the sizing of panty hose between the various panty hose manufacturers, the National Association of Hosiery Manufacturers has made detailed studies of the girth and length dimensions of the legs and lower body portions of a substantial percentage of the female population. Using these dimensions, a set of regression equations has been developed to determine the volumetric area which should be provided in each portion of the panty hose, when compared to the height and weight of the wearer. Using this information, the NAHM published recommendations on Dec. 2, 1969, and published implementation of these recommendations on Mar. 25, 1970. NAHM now provides twelve different sizes of panty hose sizing forms and these forms are generally shaped in the manner illustrated in U.S. Pat. No. Des. 221,798, issued Sept. 7, 1971. This form includes an angularly extending foot portion, a substantially straight front edge with a contoured rear edge including a calf area, a thigh area and a body portion with an unusually sharply curved or rounded buttocks protrusion.

Use of these NAHM forms has been made by certain panty hose manufacturers. However, the use of these forms has been limited because it is extremely difficult and tiring for a person to continuously draw panty hose onto and off of the forms and it is difficult to position the panty hose on the forms with the same amount of tension in all areas of the panty hose. For example the fabric tends to be stretched to a greater extent around the protruding heel and buttocks areas of the form. Also, it is expensive to purchase and maintain twelve different sizes of forms in inventory. It is time consuming to properly size a particular panty hose in accordance with the current practice which includes drawing the panty hose onto as many as four or five different size forms until it is determined that the particular panty hose fits a particular form better than the next adjacent size forms.

SUMMARY OF THE INVENTION

With the foregoing in mind, it is an object of the present invention to provide a panty hose sizing form which is contoured symmetrically along opposite side edges in such a manner that the panty hose may be easily drawn onto and removed from the form and which also enables the operator to quickly place the panty hose on the form with a uniform amount of tension in the fabric throughout all areas of the panty hose.

With the panty hose sizing form of the present invention, it is possible to greatly reduce the number of different sizes of panty hose sizing forms which must be provided in order to provide the proper size panty hose for substantially the full range of sizes of the female population. For example, it is usually only necessary to provide three different sizes of panty hose sizing forms and in some cases, depending upon the type of knit fabric and the type of stretchable yarns being used, it is necessary to provide no more than five to eight different sizes of panty hose sizing forms.

The panty hose sizing form of the present invention includes a pair of spaced-apart and identically shaped elongate boards. Each of the boards includes a rounded free end adapted to be engaged by the toe of a panty hose and an opposite end portion is adapted to be engaged by the panty portion of the panty hose. Opposite side edges of the boards are contoured symmetrically, relative to the longitudinal axis of the boards, and are longitudinally divided into areas defined as a foot portion, a calf portion, a thigh portion and a lower body or panty portion. The transverse width of the boards is substantially the same in the foot portion and progressively increases in the calf and thigh portions with slightly outwardly bulging portions in the lower body portion so that the panty hose may be easily drawn onto and off of the form and will be maintained in a uniformly stretched condition when placed on the form.

The elongate boards are preferably formed of clear plastic material so that a semitransparent sheer panty hose placed thereon may be easily inspected for defects. The panty hose sizing form is conveniently supported on a pedestal type structure which may be vertically adjusted to position the panty hose sizing form at a convenient level for ease of drawing the panty hose onto and off of the form.

BRIEF DESCRIPTION OF THE DRAWINGS

Other objects and advantages will appear as the description proceeds when taken in connection with the accompanying drawings, in which.

DESCRIPTION OF THE ILLUSTRATED EMBODIMENT

Figure 1:
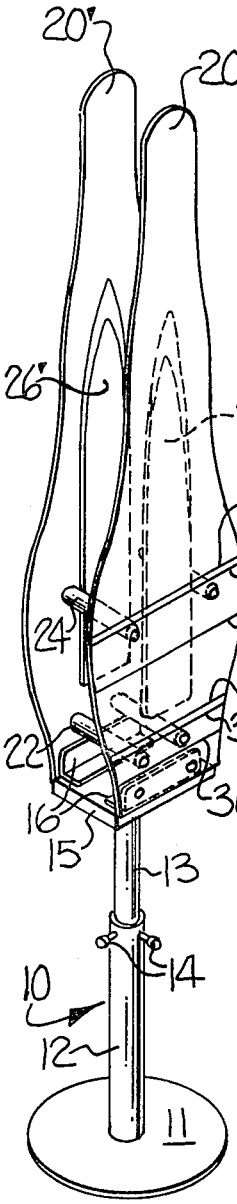
FIG. 1 is an isometric view of the panty hose sizing form of the present invention.
Figure 2:
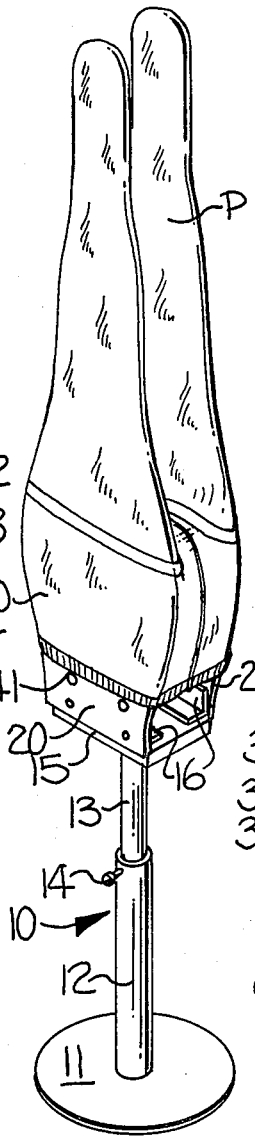
FIG. 2 is a view similar to FIG. 1 but turned 90 degrees in a clockwise direction and showing a panty hose positioned on the sizing form.

As illustrated in FIGS. 1 and 2, the panty hose sizing form is supported on a pedestal-type stand, broadly indicated at 10, which includes a circular base 11 and a lower support column 12 fixed at its lower end to the base 11. An upper support column 13 is supported at its lower end for vertical adjustment inside of the lower column 12 and is held in the desired proper vertical adjusted position by lock screws 14 which threadably penetrate the lower column 12 and engage the outer surface of the upper column 13 to support the same in the proper vertical adjustment where the boarding form will be at a convenient height for use by the person sizing the panty hose thereon.

A rectangular base 15 is fixed on the upper end of the column 13 and supports a pair of spaced-apart and identically shaped elongate boards, broadly indicated at 20 and 20'. The boards may be formed of any suitable material and are preferably formed of clear plastic material which is approximately one-quarter of an inch thick and the exposed edges of the board are preferably rounded. The lower edges of the boards 20, 20' are supported on the platform 15 by angle brackets 16 to provide means for interconnecting and maintaining the lower end portions of the boards in the proper spaced-apart relationship. A pair of lower spacer rods 22 extends between the inner surfaces of the boards 20, 20' and are held in position by suitable screws 23 which extend through the boards and are threadably embedded in the ends of the rods 22. A pair of upper spacer rods 24 extends between the boards and are spaced above the lower support rods 22 and are held in position by screws 25 which penetrate the boards and are threadably embedded in the opposite end portions of the rods 24.

Figure 3:
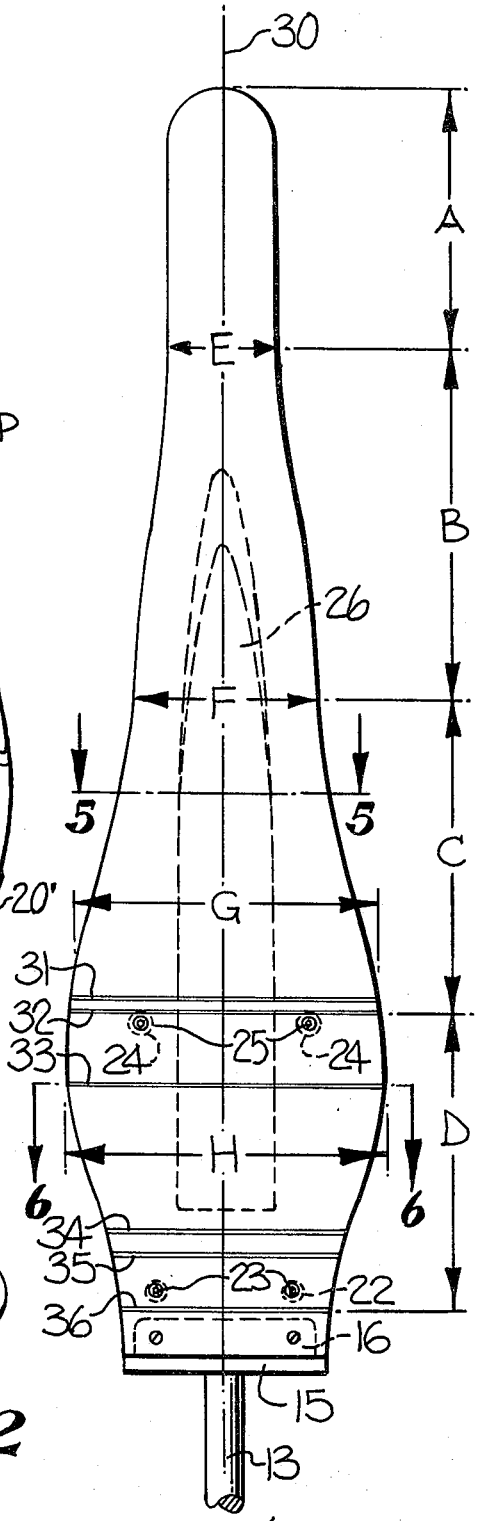
FIG. 3 is a side elevational view of one side of the sizing form.
Figure 4:
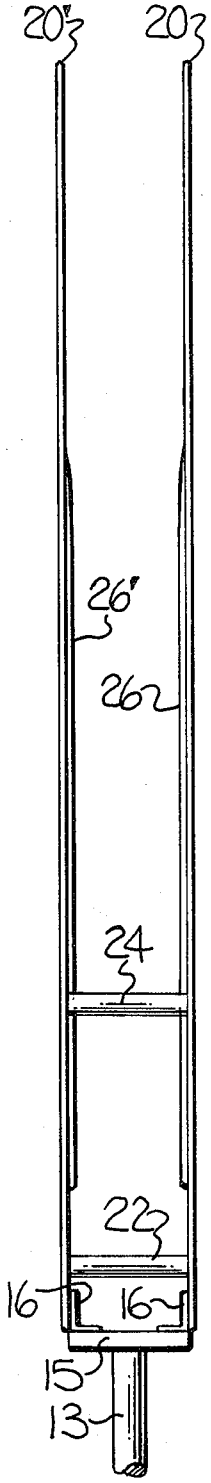
FIG. 4 is an end elevational view of the sizing form.
Figure 5:
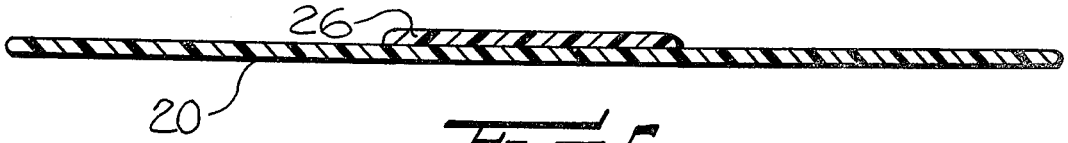
FIG. 5 is a horizontal sectional view taken along the line 5—5 in FIG. 3.
Figure 6:
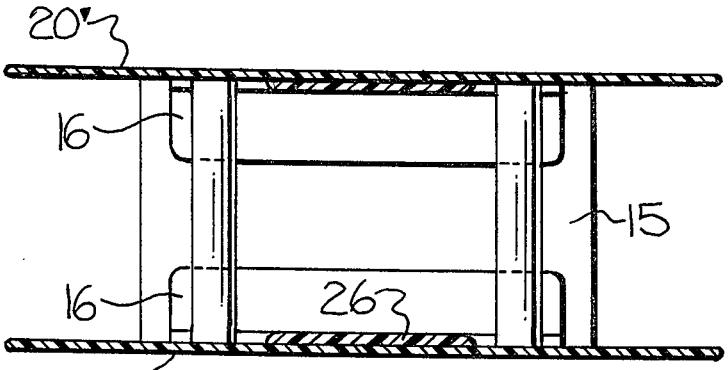
FIG. 6 is a horizontal sectional view taken substantially along the line 6—6 in FIG. 3.

Since the upper free rounded ends of the boards 20, 20' extend upwardly a substantial distance above the pedestal-type support 10, on the order of about 52 inches, it is preferred that a pair of reinforcing strips 26, 26' be secured to the inner surfaces of the respective boards 20, 20' and extend upwardly throughout a substantial length of the boards, as illustrated in dotted lines in FIG. 3. It is preferred that these strips be of substantially the same thickness as the board and that the upper end be tapered so that the reinforcing strips do not add any substantial amount of volume or area to the boards.

As best shown in FIG. 3, the board 20 is provided with a rounded upper free end adapted to be engaged by the toe of the panty hose and an opposite or lower end portion which is supported on the pedestal-type support 10 and is adapted to be engaged by the panty portion of the panty hose. Opposite side edges of the board 20 are contoured symmetrically, relative to the longitudinal axis of the board, indicated at 30 in FIG. 3.

If desired, horizontal lines of various colors may be provided on the board to indicate when the various portions of the panty hose have been drawn onto the form in the proper relationship. The colored lines are indicated at 31 through 36 in FIG. 3 and their function will be presently described. Also, dash-dot horizontal lines extend outwardly from the right-hand side of the form in FIG. 3 to indicate the various areas or portions of the form. For example, the area A extending from the upper end of the form indicates the foot portion, the area B indicates the calf portion, the area C indicates the thigh portion, and the area D indicates the lower body or panty portion of the board. The transverse width of the board 20 is substantially the same throughout the length of the foot portion A and progressively increases in width in the calf area B, and in the thigh area C. In the lower body or panty area D, the width gradually increases and then decreases to provide slight outwardly bulging areas on opposite sides.

The symmetrically contoured and progressively increasing opposite side edges of the board permits the panty hose, indicated at P in FIG. 2, to be easily drawn onto and removed from the sizing form in uniformly stretched condition throughout all of the areas in the panty hose. As indicated in FIG. 2, the foot and leg portions of the panty hose P are positioned on the upper portions of the boarding forms 20, 20' and the lower body or panty portion of the panty hose, indicated at 40, extends around and between the lower body portions of the form with the crotch area of the panty hose extending between the boards 20, 20'. The waistband 41 of the panty hose extends around the lower end portions of both of the boards 20, 20'.

Figure 7:
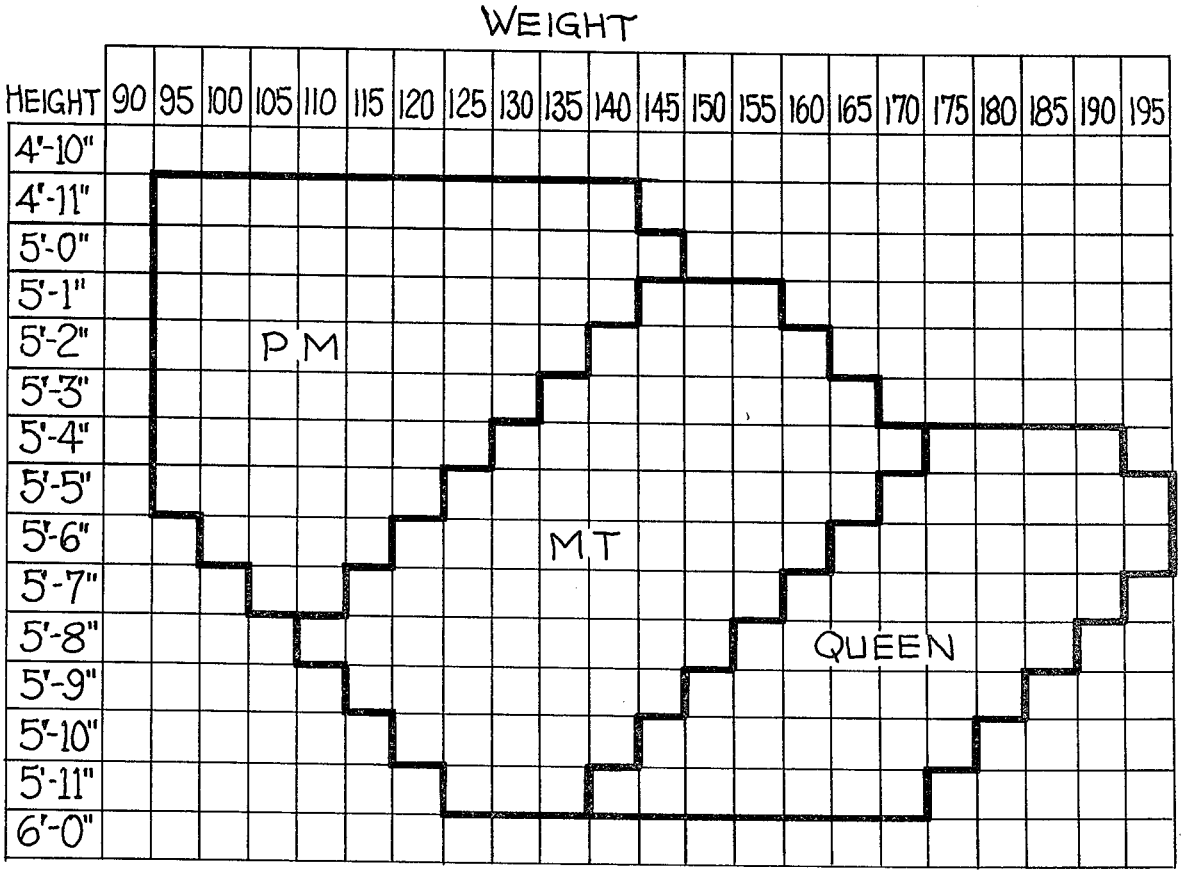
FIG. 7 is a size chart or grid of the type which is typically included on the packaging of the panty hose in order to aid the prospective purchaser in the purchase of the proper size of panty hose to fit her particular weight/height measurements.

The panty hose sizing form illustrated in the drawings is proportioned to size panty hose which may be designated with the size "petite-medium" and is knit with a sufficient number of courses of stitch loops of the proper size so that the panty hose will fit a range of women from 4'-11" to 5'-7", depending upon their respective weights, as illustrated in the chart in FIG. 7. This information is usually printed on the package in which the panty hose are sold and a particular lady can determine if this size of petite-medium panty hose will properly fit her by referring to this chart and correlating her weight along the upper horizontal line with her height along the vertical line. If these two lines meet in the area indicated "PM," then the petite-medium panty hose will provide her with a comfortable fit.

In order to determine if a particular pair of panty hose has been constructed properly to fit this range of sizes, the panty hose are drawn onto the petite-medium size panty hose sizing form. When the panty hose are drawn onto the form, the waistband 41 is pulled down to the lower line 36 on the form. Because the fabric is stretched when drawn on the form, it will relax when released and if the waistband 41 draws back up above the line 35 the overall length of the panty hose is too short. The line 34 indicates when a panty hose having a "control top" panty, which normally includes a spandex yarn, is too short. If the waistband 41 can be easily pulled down below the lower edges of the boards 20, 21', the panty hose are too long. The line 32 indicates when the leg-panty juncture is the proper length and the line 31 indicates when the legs are too short. The line 33 indicates when the legs are too long. If the panty hose do not fit this form in all areas, it indicates that they have not been properly knit and they will not be sold as a petite-medium size.

To provide a specific, but nonlimiting example, the petite-medium board 20 shown in FIG. 3 has an overall length of 52 inches. The other dimensions of this form are shown in the chart below with the width dimensions E, F, G, and H also being shown.

When three size designations are to be provided to fit substantially the entire female population, the additional size designation may be provided as medium-tall and queen size. The corresponding panty hose sizing forms for these two additional sizes would correspond in shape substantially to that of the petite-medium form shown in FIG. 3 but the dimensions would be increased in the manner indicated in the chart below, where the dimensions are given in inches.

SIZE COMPARISON CHART

| | Form Size | | |
|---|---|---|---|
| Areas | PETITE - MEDIUM | MEDIUM - TALL | QUEEN |
| A | 10½ | 10¾ | 11½ |
| B | 14½ | 14¾ | 15 |
| C | 13 | 13⅛ | 13¼ |
| D | 12 | 12 | 12 |
| E | 4 5/16 | 4½ | 4¾ |
| F | 7 5/16 | 7⅝ | 8½ |
| G | 12⅜ | 13 | 14¾ |
| H | 13 | 14¾ | 16⅝ |

Comparing the dimensions of the form, it will be noted that the boards are spaced apart a distance which is substantially less than the width of the outwardly bulging portions in the lower body portion. The boards are spaced apart a distance which is substantially the same as the width in an area of the calf portion. The width of the outwardly bulging portions of the body portion is greater than twice the width of the foot portion.

As shown on the chart or grid in FIG. 7, the size petite-medium will fit women from 4'-11" to 5'-7" with corresponding weights of from 95 to 145 pounds. Size medium-tall will fit women from 5'-1" to 5'-11" with corresponding weights of from 110 to 165 pounds. Size queen will fit women from 5'-4" to 5'-11" with corresponding weights of from 140 to 195 pounds.

The symmetrically contoured and gradually increasing opposite side edges of the panty hose sizing form of the present invention provides gradual curves along each side of the board so that the panty hose can be easily drawn onto the form and removed therefrom without applying undue stress to any particular portion of the panty hose. The panty hose are easily adjusted on the form in uniformly stretched condition to give a proper indication of the size of the panty hose being tested. The height of the panty hose sizing form can be easily adjusted to accommodate the height of the person using the sizing form so that it is positioned at a convenient height to draw the panty hose onto and remove the panty hose from the sizing form.

In the drawings and specification there has been set forth the best mode presently contemplated for the practice of the present invention, and although specific terms are employed, they are used in a generic and descriptive sense only and not for purposes of limitation, the scope of the invention being defined in the claims.

That which is claimed is:

1. A panty hose sizing form comprising a pair of spaced-apart and identically shaped flat elongate boards, each of said boards including a rounded free end adapted to be engaged by the toe of a panty hose, an opposite end portion adapted to be engaged by the panty portion of the panty hose, means interconnecting and maintaining said boards with their flat sides facing each other and with said opposite end portions of said boards in said spaced-apart relationship, and opposite side edges of said boards being contoured symmetrically, relative to the longitudinal axis of said boards, so that the panty hose can be easily drawn onto and removed from said sizing form, said boards including a foot portion adjacent said free end, a calf portion adjacent said foot portion, a thigh portion adjacent said calf portion, and a lower body portion adjacent said thigh portion, and the transverse width of said boards progressively increasing from the free end to a medial portion of said body portion and then progressively reducing in width throughout the remaining portion of said lower body portion so as to define outwardly bulging portions along opposite sides of said body portion.

2. A panty hose sizing form according to claim 1 wherein said means interconnecting and maintaining said opposite end portions of said boards in said spaced-apart relationship comprises a rectangular base supporting the lower end portions of said boards, a first pair of spacer rods fixed to and extending between the inner surfaces of the spaced-apart boards and spaced above said rectangular base, and a second pair of support rods fixed to and extending between said boards and being spaced above said first pair of spacer rods.

3. A panty hose sizing form according to claim 1 including reinforcing strips fixed on the inner surfaces of each of said boards and extending from said lower body portion and throughout at least the full length of said thigh portion.

4. A panty hose sizing form according to claim 1 wherein said boards are spaced apart a distance which is substantially less than the width of the outwardly bulging portions of said body portion.

5. A panty hose sizing form according to claim 1 wherein said boards are spaced apart a distance which is substantially the same as the width in an area of said calf portion.

6. A panty hose sizing form according to claim 1 wherein the width of said outwardly bulging portions along opposite sides of said body portion is greater than twice the width of said foot portion.

7. A panty hose sizing form according to claim 1 including a pedestal-type stand supporting said form, said stand being vertically adjustable so that said form can be adjusted to a convenient height for use.

8. A panty hose sizing form comprising a pair of spaced-apart and identically shaped flat elongate boards, each of said boards including a rounded free end adapted to be engaged by the toe of a panty hose, an opposite end portion adapted to be engaged by the panty portion of the panty hose, means interconnecting and maintaining said boards with their flat sides facing each other and with said opposite end portions of said boards in said spaced-apart relationship, and opposite side edges of said boards being contoured symmetrically, relative to the longitudinal axis of said boards, so that the panty hose can be easily drawn onto and removed from said sizing form, said boards including a foot portion adjacent said free end, a calf portion adjacent said foot portion, a thigh portion adjacent said calf portion, and a lower body portion adjacent said thigh portion, the transverse width of said boards progressively increasing from the free end to a medial portion of said body portion and then progressively reducing in width throughout the remaining portion of said lower body portion so as to define outwardly bulging portions along opposite sides of said body portion, said boards being spaced apart a distance which is substantially the same as the width in an area of said calf portion, and the width of said outwardly bulging portions being greater than twice the width of said foot portion.

* * * * *